US005195432A

United States Patent [19]

Bergmann

[11] Patent Number: 5,195,432

[45] Date of Patent: Mar. 23, 1993

[54] COMPACTOR FOR WASTES, IN PARTICULAR TRASH

[76] Inventor: Heinz Bergmann, Im Runderdiek 1, 4474 Lathen, Fed. Rep. of Germany

[21] Appl. No.: 745,203

[22] Filed: Aug. 15, 1991

[30] Foreign Application Priority Data

Aug. 31, 1990 [DE] Fed. Rep. of Germany ..... 4027217

[51] Int. Cl.[5] ..... B30B 15/06; B30B 7/00

[52] U.S. Cl. ..... 100/229 A; 100/233; 100/245; 100/288; 100/295; 414/521; 414/525.6

[58] Field of Search ..... 100/215, 229 A, 226, 100/233, 240, 245, 288, 295; 414/509-512, 515-517, 521, 525.6; 37/118 R

[56] References Cited

U.S. PATENT DOCUMENTS

| | | | |
|---|---|---|---|
| 3,231,111 | 1/1966 | Clar | 414/525.6 |
| 3,318,231 | 5/1967 | Felts | 100/229 A X |
| 3,584,755 | 6/1971 | Smith | 100/295 X |
| 3,608,479 | 9/1971 | Pioch | 100/229 A |
| 4,069,929 | 1/1978 | Harker | 414/525.6 X |
| 4,145,824 | 3/1979 | Watson | 100/233 X |
| 4,685,856 | 8/1987 | Hesse, Jr. | 414/521 X |
| 5,067,868 | 11/1991 | Boda | 100/233 X |

FOREIGN PATENT DOCUMENTS

| | | | |
|---|---|---|---|
| 2225157 | 1/1973 | Fed. Rep. of Germany | 100/295 |
| 42409 | 7/1933 | France | 414/521 |

*Primary Examiner*—Harvey C. Horsby
*Assistant Examiner*—Stephen F. Gerrity
*Attorney, Agent, or Firm*—Longacre & White

[57] ABSTRACT

The invention concerns a compactor for wastes, in particular for compressible trash, and includes a compaction plunger with a compaction blade in the lower part of a trash receiving chamber of a compactor housing. The plunger is horizontally displaceable and conveys the trash into a container adjoining the receiving chamber where the trash is compacted. The invention provides a scoop pivotally supported by the compaction plunger and comprising an acute-angle leading edge for slipping underneath the trash which is continuously accumulating in the receiving chamber. During the return stroke of the plunger, the scoop can be tipped upward about its pivot axis so that the trash behind the compaction plunger is moved in front of the compaction blade of the compaction plunger.

14 Claims, 3 Drawing Sheets

COMPACTOR FOR WASTES, IN PARTICULAR TRASH

BACKGROUND OF THE INVENTION a) Field of the Invention

The invention concerns a compactor for wastes, in particular for compressible trash, comprising a compaction plunger operating in the lower part of a trash receiving chamber of a compactor housing. The compaction plunger is horizontally displaceable to move the trash into a container adjacent to the receiving chamber and compact it in the container.

b) Description of the Prior Art

In known trash compaction machines having a horizontally displaceable plunger, the trash being compacted may slip behind the compaction plunger, especially when the receiving chamber is loaded continuously. In this condition, the return stroke of the compaction plunger is hampered by the trash present there, whereby the machine may be worn prematurely, shut down or damaged. It is already known in such machines to provide a cover apparatus closing the receiving chamber during operation of the compaction plunger.

In these known designs, the cover apparatus—which is activated by the compaction plunger and, illustratively, is pulled apart and compressed by it like venetian blinds—prevents trash from being loaded behind the compaction plunger which would hamper the return stroke in the manner described above.

However, the mechanically displaceable cover apparatus of the known systems incur the drawback of being, on one hand, susceptible to malfunctioning, and on the other hand susceptible to wear, and consequently the service life of such systems is short. Another drawback is that the known cover means occupy a significant space in the receiving chamber, and therefore the output of the known systems is comparatively slight.

SUMMARY OF THE INVENTION

It is the object of the invention to provide a waste compactor which allows waste to be continuous received using an improved means for preventing accumulation of waste behind the compaction plunger and provides a high degree of compacting efficiency.

The invention permits the receiving chamber to be continuously filled and provides a scoop mounted on the compaction plunger which is functional during the return stroke. The scoop is tipped upward at the end of the return stroke, whereby the waste from behind the scoop is conveyed in front of the compaction blade of the compaction plunger.

The invention makes it possible to have trash which arrived at the back side of the compaction plunger during its return stroke conveyed in front of the compaction blade of the compaction plunger thereby enabling continuous feeding without requiring covering apparatus. A special advantage is also achieved, namely that trash presenting difficulties in moving, in particular wet trash, can be easily conveyed in front of the compaction blade—this being difficult in known designs because wet trash adheres to the cover apparatus or the like.

Moreover, the volume of the receiving chamber located behind the compaction blade of the compaction plunger is not significantly reduced in the invention because the scoop requires comparatively little space during the conveyance process due to its being tipped over in the receiving chamber. On account of the acute-angle wedge shape of the scoop, practically the entire space between the leading edge of the scoop and the rear wall of the compaction blade is available for the receiving chamber.

Advantageously, the tipping is initiated and carried out by actuating the scoop leading edge.

Appropriately, the scoop may be equipped with two triangular side plates which bracket the compaction plunger.

Advantageously, the scoop is supported in a corner region of the side plates closest to the line of action of the compaction drive.

In an especially advantageous manner, these supporting corners may be spaced very closely to the bottom of the equipment in order to facilitate tipping, i.e. to carry it out with little power.

Even though tipping can easily be implemented by using gears, cables or the like acting on the side plates, or by using outward-pointing pins mounted on the scoop side plates cooperating with corresponding guides stationary in the housing, it is advantageous that tipping be carried out by using the return stroke force and the acute-angle shape of the scoop and providing a guide or the like near the back wall of the receiving chamber to rotate the scoop in a suitable manner.

In an especially advantageous manner, the leading edge of the scoop itself is utilized for tipping. This can be achieved by suitably designing the back wall of the receiving chamber, distal from the container, to have a cross-sectional shape composed of circular arcs and/or lineal segments. The leading edge of the scoop rides upon the cross-sectional shape during the return stroke, thereby being rotated without resort to additional components.

The compaction plunger further comprises an arcuate cover, the radius of which is determined by its distance from the horizontal axis of rotation of the scoop. The cover may be linked to the surface of the scoop and/or may connect the two side plates.

The equipment of the invention is exceedingly well suited for operating in a receiving chamber which has an arbitrary fixed length.

The invention is elucidated below by an illustrative embodiment shown in the drawing.

DESCRIPTION OF THE PREFERRED EMBODIMENT

Figure 1:
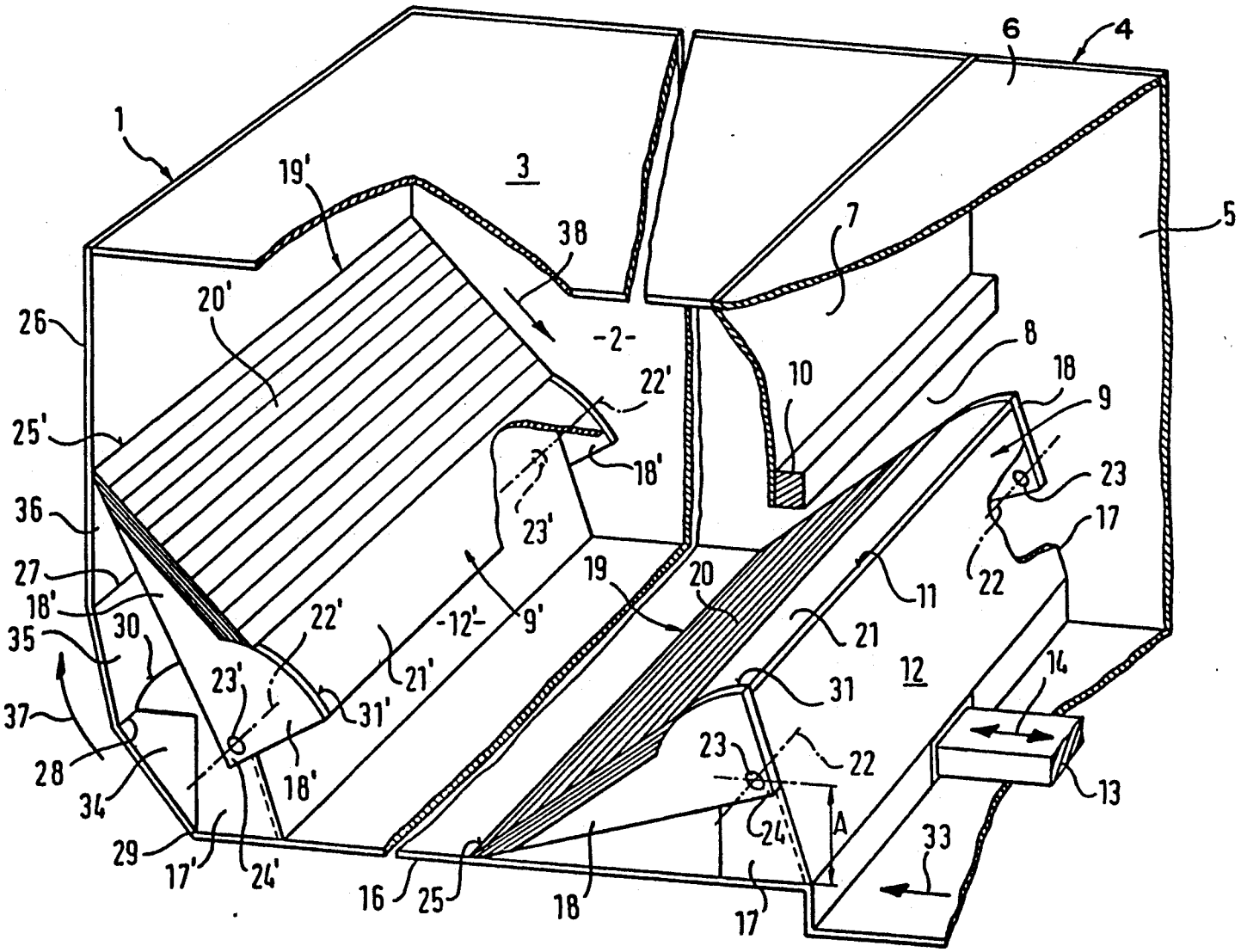
FIG. 1 is a partial cutaway showing a preferred embodiment of the invention in both a compaction position and a return position, shown on the right and left sides of the Figure, respectively. The same elements in the return position are indicated with a prime (').

The compactor consists of a housing 1 comprising an upwardly opening receiving chamber 2, which may be closed by a removable top 3, to receive the trash to be compacted.

A container 4 adjoins the housing 1 and comprises sidewalls 5 and an upper sealing cover 6. The container 4 is separated from the receiving chamber 2 by a partition 7 having an aperture 8 essentially in the lower part of the partition 7. A compaction plunger 9 passes through the aperture 8 as needed. A sturdy reinforcement 10 in the region of the upper edge of aperture 8 increases the rigidity of partition 7. The upper edge of the aperture 8 is spaced only slightly away from an upper edge 11 of a compaction blade 12 of the compaction plunger 9 and cooperates with the upper edge of the aperture 8 to sever waste extending between the receiving chamber 2 and the container 4.

A drive 13 for the compaction plunger 9 is shown schematically. This drive 13 may consist mechanically of a gear rack, a spindle or the like, but advantageously it is a hydraulic system. The drive 13 moves the compaction plunger 9 in the directions of the double arrow 14 between the receiving chamber 2 and the container 4.

The compaction plunger 9 comprises two risers 17 which support the compaction blade 12 and are slidable upon a bottom 16 of the receiving chamber 2. The compaction plunger 9 pivotally supports a scoop 19. Scoop 19 comprises side plates 18 fixed to a scooping surface 20 and a cross-sectionally arcuate cover 21. Bearings 23 are used to pivotally support scoop 19 on risers 17 about an axis 22.

The side plates 18 are triangular, with a corner 24 opposite the scooping surface 20 and the cover 21. Bearing 23 is located in corner 24 as close as possible to the bottom 16 of the receiving chamber 2 to facilitate the scoop 19 penetrating at the most acute angle possible underneath the trash present in the receiving chamber 2.

The compaction plunger 9 moves essentially in translation during compaction, the scoop 19 linked to the compaction plunger 9 being pivoted about axis 22 only as the compaction plunger approaches the return position during the return stroke.

A leading edge 25 of scooping surface 20 subtends an acute angle, whereby this scoop 19 can very easily slip underneath any trash in the receiving chamber 2 during its return stroke.

Figure 3:
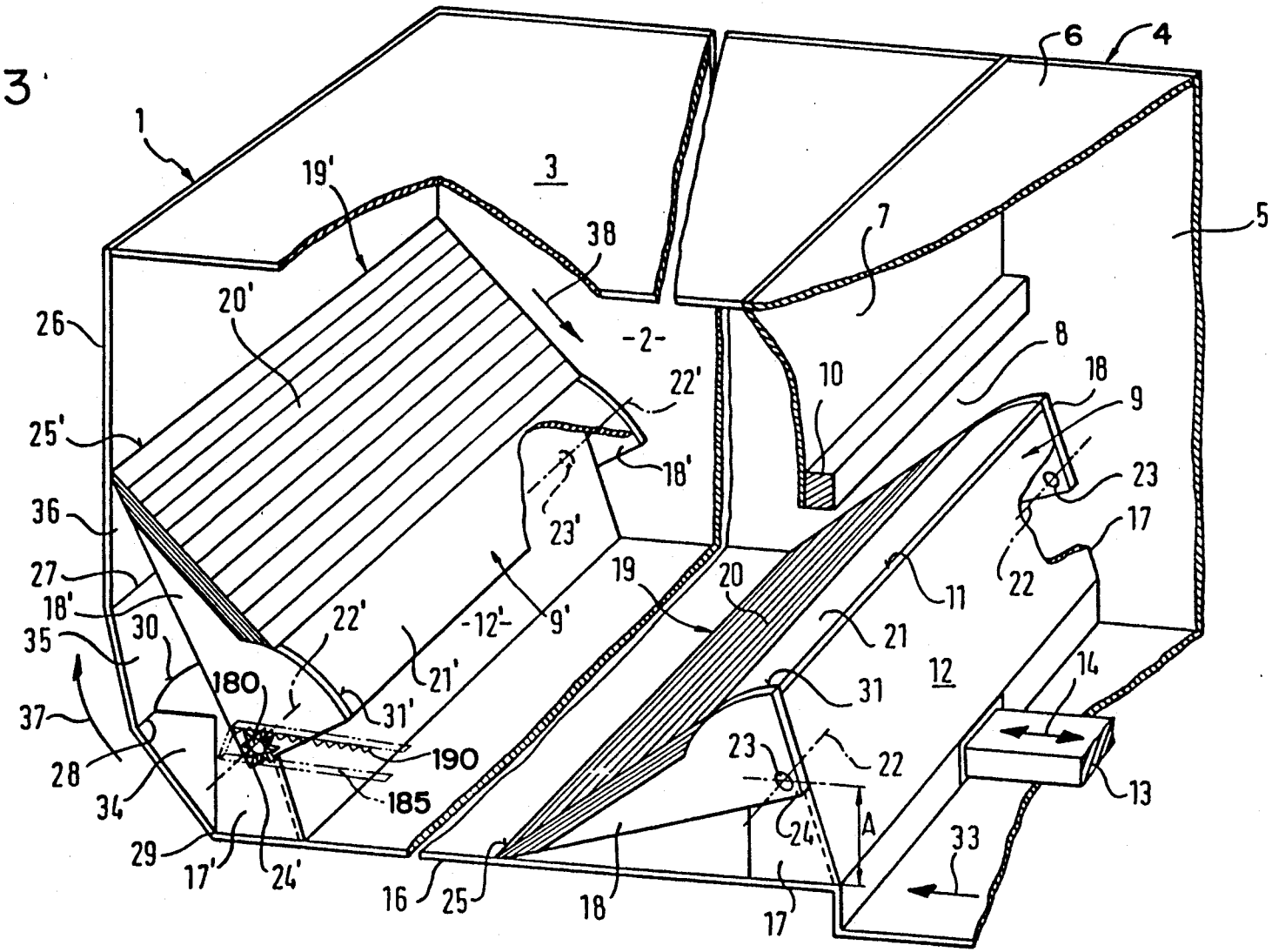
FIG. 3 is a partial cutaway showing a third preferred embodiment of the invention.

The cross-sectional shape of a back wall 26 of the receiving chamber 3 can be arcuate, or it may be formed from lineal segments, as for example defined by edges 27–29 and wall segments 34–36, which is suitable to guide the leading edge 25 of the scoop 19 upward, causing pivoting about axis 22. In a second embodiment, external pointing pins **18*a* may be provided on the side plates 18 as shown in FIG. 3. These pins 18*a* cooperate with corresponding guides 18*b* provided on the compactor housing to implement tipping of the scoop 19. The risers 17 have arcuate upper edges 30 of which the curvatures correspond to the curvature of the cover 21 and to the arcuate curvature of edges 31 of the side plates 18**.

Figure 2:
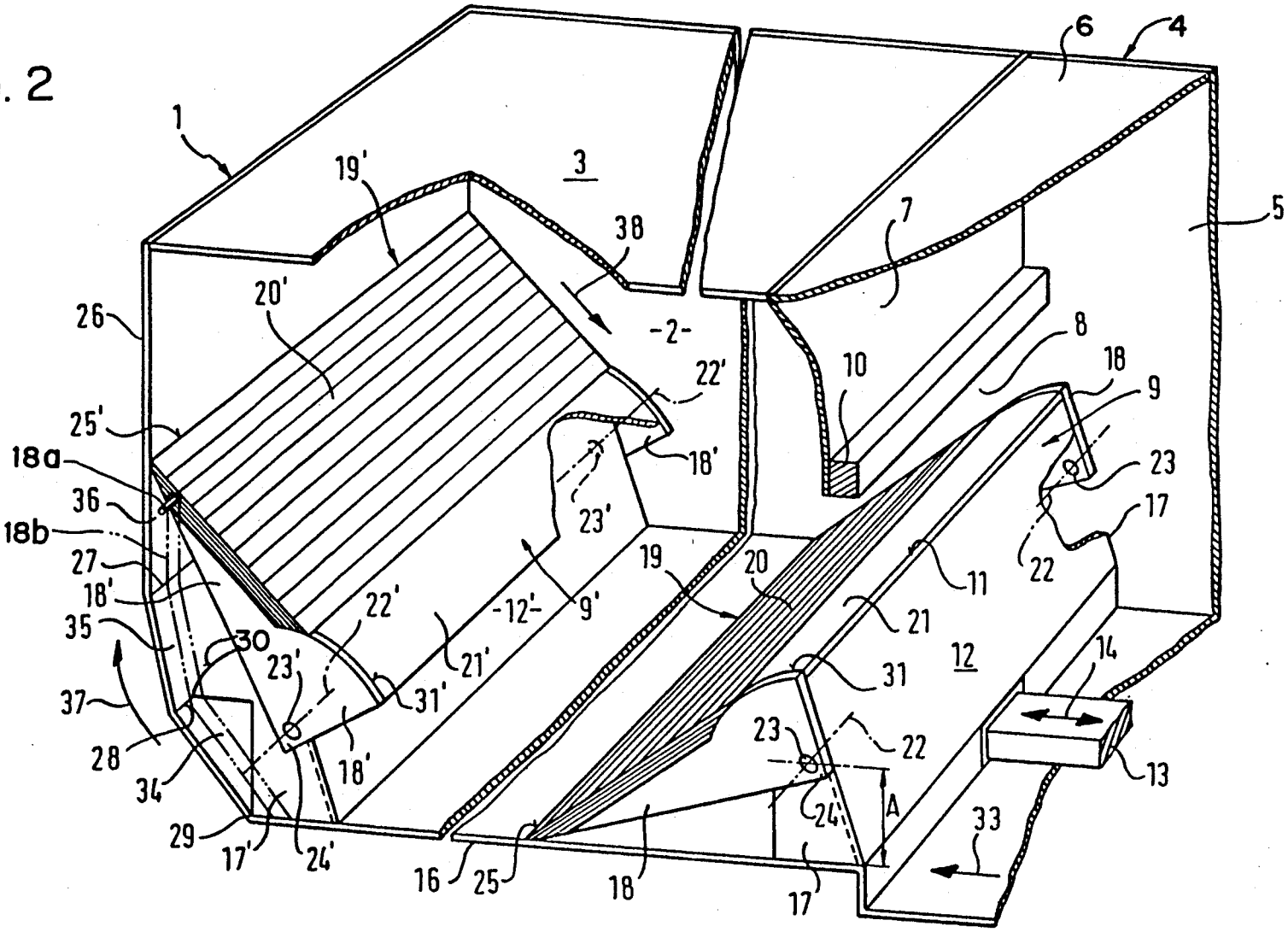
FIG. 2 is a partial cutaway showing a second preferred embodiment of the invention.

By way of example, a secondary embodiment is shown in FIG. 2 whereby tipping of the scoop 19 is implemented by the use of gears 180 which are non-rotatably mounted on the side plates 18. Provided in the compactor housing is a corresponding internally toothed groove 185 which receives the gear 180. During translational motion of the compaction plunger 9 from the compaction position to the return position, the gear slides in the groove 185 until it engages teeth 190 provided on the top side of the groove 185. The engagement of the gear 180 with the teeth 190 causes the scoop 19 to tip in an upwardly direction as shown in FIG. 2.

The described equipment operates as follows:

The same compaction plunger 9, is shown in a compaction position and a return position, on the right and left sides of the Figure, respectively. In the shown compaction position, the compaction plunger 9 has already moved into the container 4 to compact the waste and is ready to begin moving back in the direction of the arrow 33. Approaching the return position, the leading edge 25 slides on the bottom 16 of the receiving chamber 2 and moves underneath any waste therein. As the leading edge 25 arrives at the edge 29 and begins to ride up wall segment 34, a first rotation 37 of the scoop 19 about its axis 22 takes place. The first rotation 37 increases as the leading edge 25 continues riding up adjoining and still steeper wall segments 35 and 36. The first rotation becomes smoother if the adjoining surface segments of the back wall 26, in lieu of being lineal, are cross-sectionally arcuate.

The waste in the receiving chamber 2 is first displaced from the bottom 16 by the leading edge 25 and then is raised in relation to the motion of the scoop 19 as the leading edge 25 follows the contour of the back wall 26, whereby the waste is conveyed down along the scoop surface 20 in the direction of the arrow 38 and subsequently slides over the curved cover 21 in front of the compaction blade 12.

In this manner, the approach of the compaction plunger toward the return position is exploited to improve subsequent compaction.

In the disclosed embodiment, additional cover means can be eliminated, and therefore the design of the invention suffices with very few components which moreover are mounted in a wear-resistant manner and make possible a large output on account of the utilization of both compaction and return movements of the compaction plunger.

What is claimed is:

1. A compactor for continually receiving and compacting wastes, in particular for compressible trash, a compaction plunger with a compaction blade in a lower part of a trash receiving chamber in a compactor housing, said plunger being mounted in a horizontally displaceable manner and moving the trash into a container adjoining the receiving chamber and compacting the trash therein, a scoop being supported by the compaction plunger so as to be rotatable about a horizontal axis and comprising an acute-angle leading edge distal form the compaction blade to slide underneath the trash in the receiving chamber during a return stroke of the compaction plunger, toward the end of the return stroke the scoop being tipped upward about the horizontal axis by a tipping means for tipping the scoop about said horizontal axis whereby the trash is moved by the scoop in front of the compaction blade of the compaction plunger.

2. The compactor defined in claim 1, characterized in that the tipping means initiates and carries out the tipping by applying a force to the acute-angle leading edge.

3. The compactor defined in claim 1, characterized in that the scoop comprises two side plates which externally bracket the compaction plunger.

4. The compactor defined in claim 3, characterized in that the side plates are triangular.

5. The compactor defined in claim 4, characterized in that the scoop is supported near one corner of the triangular side plates which is proximate to both the compaction blade and a bottom of the receiving chamber.

6. The compactor defined in claim 5, characterized in that the corner supports are substantially adjacent the bottom of the receiving chamber.

7. The compactor defined in claim 3, characterized in that the tipping means comprises gears, a cable or the like acting on the side plates for implementing tipping of the scoop.

8. The compactor defined in claim 3, characterized in that the tipping means comprises externally pointing pins provided on the side plates of the scoop which during the return stroke cooperate with a corresponding guide means stationary in the compactor housing.

9. The compactor defined in claim 1, characterized in that said tipping means comprises a guide means for applying a force to the acute-angle leading edge, said guide means being mounted on a back wall of the receiving chamber such that as the compaction plunger approaches the end of the return stroke, the scoop is correspondingly rotated.

10. The compactor defined in claim 1, characterized in that the acute-angle leading edge engages said tipping means for tipping said scoop.

11. The compactor defined in claim 10, characterized in that said tipping means comprises a back wall of the receiving chamber which is distal from the container and has a cross-sectional shape formed from arcs of a circle or lineal segments, the acute-angle leading edge of the scoop sliding upon said back wall during the return stroke and thereby rotating the scoop about the horizontal axis.

12. The compactor defined in claim 1, characterized in that the compaction plunger comprises a cross-sectionally arcuate cover, the radius of which is determined by a distance from the horizontal axis of the scoop to a top edge of the compaction blade.

13. The compactor defined in claim 12, characterized in that the arcuate cover adjoins a scoop surface of the scoop.

14. The compactor defined in claim 12, characterized in that the arcuate cover connects a pair of side plates.

* * * * *